United States Patent [19]

Schaar

[11] Patent Number: 4,607,606

[45] Date of Patent: Aug. 26, 1986

[54] BOW MOUNTED QUIVER

[75] Inventor: John Schaar, Tempe, Ariz.

[73] Assignee: Grand Slam Archery, Phoenix, Ariz.

[21] Appl. No.: 526,661

[22] Filed: Aug. 26, 1983

[51] Int. Cl.[4] ..... F41B 5/00

[52] U.S. Cl. ..... 124/89; 124/88; 224/916

[58] Field of Search ..... 124/23 R, 23 A, 24 R, 124/24 A, 41 A, 41 P, 45, 86, 88, 89; 224/916

[56] References Cited

U.S. PATENT DOCUMENTS

| | | | |
|---|---|---|---|
| 2,969,898 | 1/1961 | Ramsey | 124/23 A |
| 3,116,730 | 1/1964 | Tingley | 124/24 A |
| 3,209,740 | 10/1965 | Hauch | 124/24 A |
| 3,524,441 | 8/1970 | Jeffery | 124/89 X |
| 4,020,984 | 5/1977 | Morris | 124/24 A X |

*Primary Examiner*—Richard C. Pinkham
*Assistant Examiner*—Benjamin Layno
*Attorney, Agent, or Firm*—Don J. Flickinger; Jordan M. Meschkow

[57] ABSTRACT

A bow mounted quiver includes a storage apparatus for releasably housing a plurality of arrows on one side of the bow and a counterweight mounted on an opposite side of the bow to compensate for the twisting torque produced by the weight of the storage apparatus and the arrows contained therein. Both the counterweight and the storage apparatus are secured to the bow by means of externally threaded shaft members. In a preferred embodiment, one counterweight threadably engages the external threads on the shaft member and is rotatable thereon so as to vary the torque produced thereby. That is, as arrows are removed from the quiver, the counterweight may be rotated clockwise so as to cause its movement toward the bow. As arrows are added to the quiver, the counterweight is rotated counter-clockwise increasing its distance from the bow and thereby increasing the torque produced thereby.

18 Claims, 12 Drawing Figures

BOW MOUNTED QUIVER

BACKGROUND OF THE INVENTION

This invention relates generally to archery equipment, and particularly, to an improved bow mounted quiver. More particularly, the invention relates to a bow mounted quiver which includes means for storing a plurality of arrows on one side of a bow and a counterweight extending from the other side of the bow which to compensates for the weight of the storage means and the arrows contained therein thus substantially eliminating any net torque and the resultant tendency of the bow to twist in the archer's hand.

Bow mounted quivers are well known. Generally, such devices include an upper region for receiving the points of the arrows stored in the quiver and a lower arrow shaft holder. Means are provided for coupling both the upper and lower sections to a central portion of the bow generally on the opposite side of the riser portion and sight window opening. That is, the known quiver will extend from the right side of the bow. The additional weight of the quiver extending from the right-hand side of the bow creates a tendency for the bow to twist in the archer's hand. This, unfortunately, seriously degrades the archer's performance.

SUMMARY OF THE INVENTION

It is an object of the present invention to provide an improved bow mounted quiver.

It is a further object of the present invention to provide a bow mounted quiver which provides for substantially equal weights on both sides of the bow so as to avoid any tendency of the bow to twist in the archer's hand.

It is a still further object of the present invention to provide a bow mounted quiver which includes a counterweight for compensating for the weight of the arrows and the main portions of the quiver.

Still another object of the present invention is to provide an improved bow mounted quiver which is easy to mount.

Yet another object of the present invention is to provide an improved bow mounted quiver which requires no intermediate mounting fixture for coupling to a bow.

It is a further object of the present invention is to provide a bow mounted quiver including an adjustable counterweight which may be varied as arrows are added to or removed from the quiver.

According to a broad aspect of the invention there is provided a quiver capable of being mounted to a bow and which includes storage means capable of releasably housing at least one arrow. Coupling means are provided for attaching the storage means to a first side of the bow. Counterweight means are mounted on the coupling means and extend from a second opposite side of the bow to compensate for the weight of the storage means and the arrows contained therein. In a preferred embodiment, the distance that one of the counterweights extends from the bow may be varied as arrows are removed from or added to the quiver. The counterweight will extend further from the bow when the quiver is full of arrows, and will reside close to the bow when the quiver is empty.

The above and other objects, features and advantages of the present invention will be more clearly understood from the following detailed description taken in conjunction with the accompanying drawings, in which:

DESCRIPTION OF THE PREFERRED EMBODIMENT

Figure 1A:
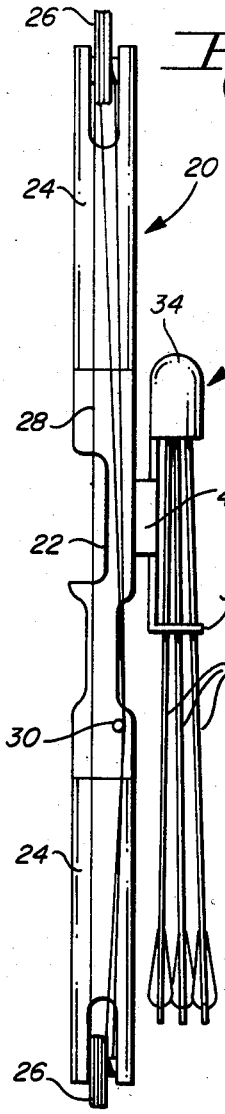
FIG. 1a (PRIOR ART)
FIGS. 1*a* and 1*b* are rear and side views respectively of a compound bow equipped with a bow mounted quiver in accordance with the prior art.
Figure 1B:
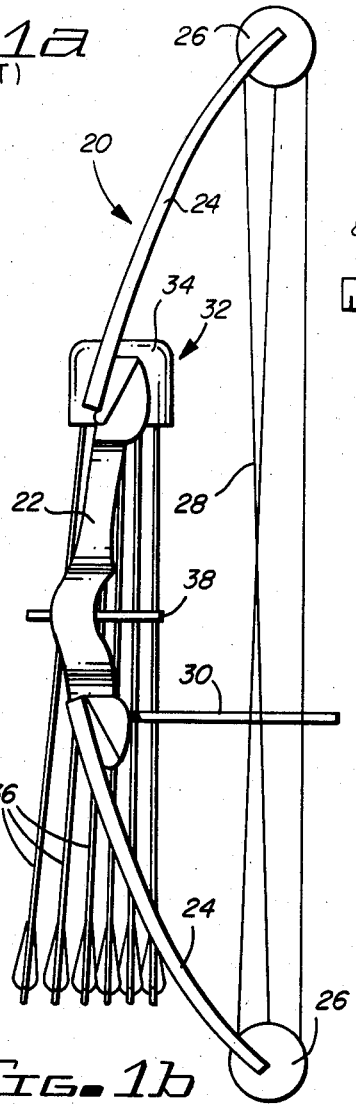

FIGS. 1*a* and 1*b* are rear and side views of a conventional compound bow generally denoted 20 of the type which includes a handle riser 22, limbs 24, pulleys 26, cable 28 and cable guard 30. As can be seen, a quiver generally denoted 32 includes an upper portion 34 for receiving the pointed ends of arrows 36. The shafts of arrows 36 are secured in a shaft holder 38.

The quiver is coupled to the riser section 22 by means of a coupling means 40. If we assume that bow 20 is being held by an archer and that the archer's wrist represents a pivot point, the additional weight on the right side of the bow caused by the presence of quiver 32 and the arrows contained therein will create a clockwise torque which must be compensated for by the archer. This is not only a burden to the archer, but may seriously degrade his accuracy.

Figure 2:
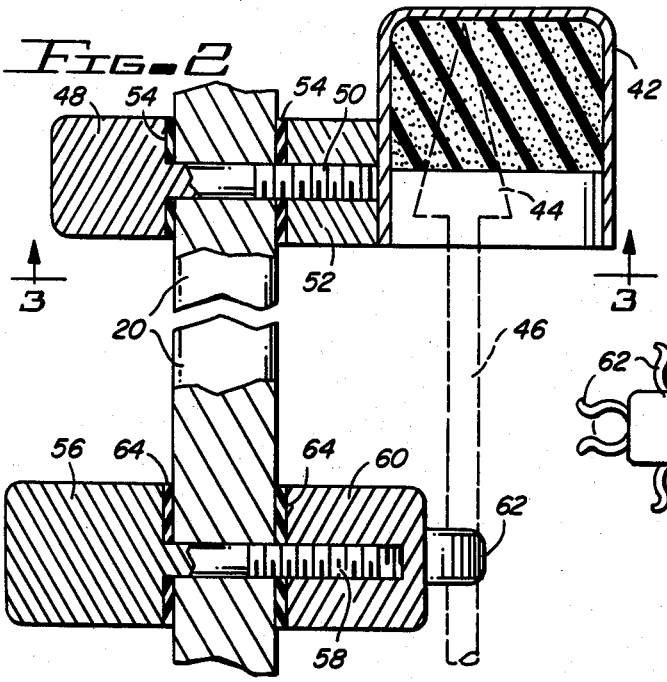
FIG. 2 is a cross-sectional view of a first embodiment of the present invention.

FIG. 2 is a first embodiment of an inventive quiver which compensates for the additional weight and reduces the net torque caused thereby. An upper portion 42 has a filler material therein (e.g. rubber, styrofoam, etc.) for receiving the pointed ends 44 of arrows 46. While only one arrow is shown, it is to be understood that the quiver will accommodate a plurality of arrows. A counterweight 48 is provided with a long stem 50 which is externally threaded and passes through an aperture in bow 20. Stem 50 is externally threaded so as to engage the internal threads on a coupling section 52 which is fixedly coupled or formed integrally with upper portion 42. If desired, rubber damper pads 54 may be utilized as cushions between coupling section 52 and bow 20 and between counterweight 48 and bow 20. In a similar manner, a lower counterweight 56 having a threaded stem 58 extending through bow 20 engages an arrow shaft holder 60. Arrow shaft holder 60 is equipped with a plurality of arrow clips 62 which grip the shaft of arrow 46 in a manner to be discussed in more detail below. Again, rubber damper pads 64 may be provided between counterweight 56 and bow 20 and between arrow shaft holder 60 and bow 20. The total weight of counterweights 48 and 56 are chosen so as to offset that portion of the quiver on the right side of the bow when the quiver is housing a number of arrows equivalent to half its total capacity. That is, if the quiver can accommodate twelve arrows, the weight of counterweights 48 and 56 are chosen to offset the weight of the quiver and six arrows. In this manner, the twisting torque is at least significantly reduced.

Figure 4:
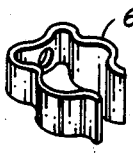
FIG. 4 is a perspective view of an arrow clip of the type used in conjunction with the apparatus shown in FIG. 5.
Figure 3:
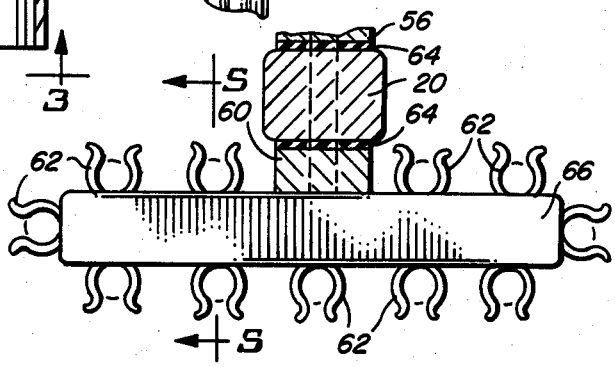
FIG. 3 illustrates a first shaft holding apparatus for use with the present invention.
Figure 5:
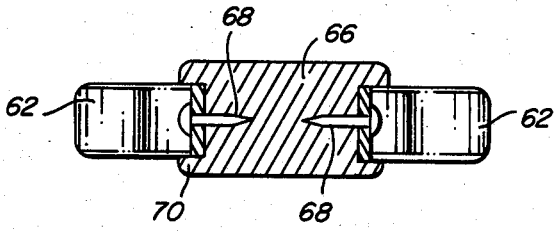
FIG. 5 is a cross-sectional view taken along line 7—7 in FIG. 3.

Referring to FIG. 3, the arrow shaft holder 16 is shown in more detail in a top cross-sectional view taken along line 3—3 in FIG. 2. As can be seen, the arrow shaft holder is equipped with a plurality of arrow clips 62 (of the type shown in more detail in FIG. 4). Each of the arrow clips is inserted into a channel and secured by means of a screw. The walls of the channel act so as to prevent the arrow clips from twisting. This can be seen more readily in FIG. 5 which is a cross section taken along line 5—5 in FIG. 3. As can be seen, each of the arrow clips 62 is secured to the main body 66 of the shaft holder by means of a screw 68 (or other similar fastener). Since the channel 70 is only wide enough to permit insertion of clips 62, any tendency to twist on the part of clips 62 will be resisted by the walls of the channel.

Figure 6:
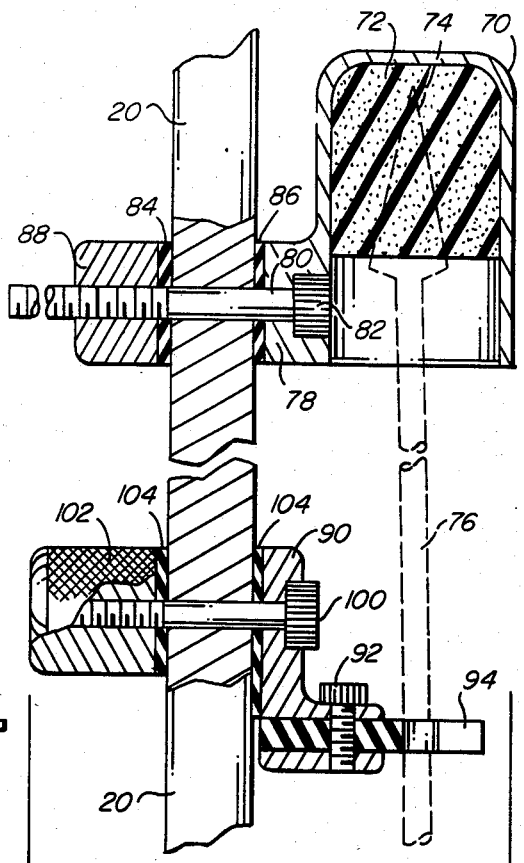
FIG. 6 is a view, partially in cross section, of a second embodiment of the present invention.

FIG. 6 illustrates an alternate embodiment of the inventive bow mounted quiver wherein the amount of offset torque produced by the counterweights is variable. Referring to FIG. 6, the quiver again contains an upper portion 70 having a filler material 72, such as rubber or styrofoam, therein for receiving points 74 of arrows 76. Upper portion 70 is provided with a coupling extension 78. A cap screw 80 having head 82 passes through bow 20 and threadably engages a lock nut 84. A rubber damper 86 may be placed between bow 20 and coupling section 78 as shown. A counterweight 88 is also threadably mounted on cap screw 80 and is capable of rotation thereon for reasons and in a manner to be discussed below.

Figure 7:
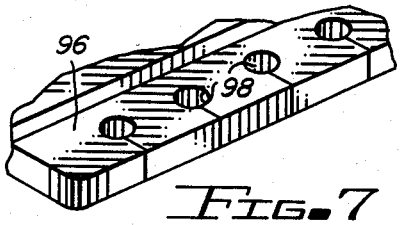
FIG. 7 illustrates a second shaft holding apparatus for use in conjunction with the present invention.

A lower portion 90 of the inventive quiver has coupled thereto by means of screw 92 an arrow shaft holder 94. In this case, arrow shaft holder 94 may be a flexible material 96 having apertures 98 therein as is shown in more detail in FIG. 7. For example, this shaft holder may be manufactured from die cut soft rubber. A second cap screw 100 passes through lower portion 90 and bow 20, and threadably engages a second counterweight 102 on the opposite side of bow 20. Again, rubber damper pad 104 may be employed between bottom portion 90 and bow 20 and between counterweight 102 and bow 20. Counterweight 102 is not adjustable but is merely screwed onto cap screw 100 so as to secure itself and lower portion 90 to the bow.

Figure 8:
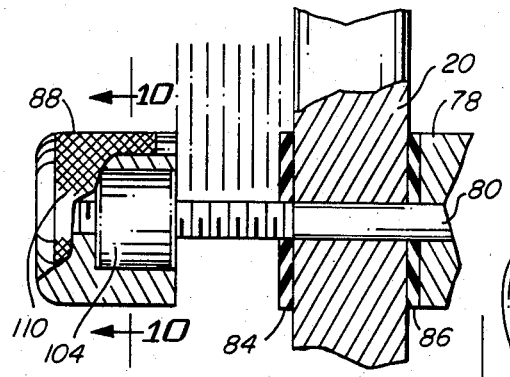
FIG. 8 is a cross-sectional view illustrating the operation of the embodiment shown in FIG. 6.

As stated previously, counterweight 88 threadably engages cap screw 82 and is rotatable thereon. Therefore, the distance between counterweight 88 and lock nut 84 may be varied depending on the amount of torque which is necessary to offset the torque produced by the quiver on the right side of the bow and the arrows contained therein. For example, FIG. 8 illustrates a situation wherein counterweight 88 has been unscrewed so as to extend a distance away from lock nut 84 so as to compensate for a full quiver on the other side of the bow. As the arrows in the quiver are exhausted, counterweight 88 may be rotated clockwise so as to move it toward lock nut 84. In this manner, the amount of offsetting torque produced by counterweight 88 may be varied so as to precisely offset the weight of the remaining portions of the quiver and the arrows contained therein on the other side of the bow.

Counterweight 88 may be comprised of an internal weight 104 and a press fit cover 106 having an outer knurled surface. In this manner, weight 104 may accommodate a clicker apparatus such as a type shown in FIG. 9. Let us assume that the space between threads on cap screw 80 corresponds to the distance counterweight 88 must be moved inward when a single arrow is removed from the quiver. To achieve the proper balance at all times, it would therefore only be necessary to rotate counterweight 88 a single revolution toward lock nut 84 each time an arrow is removed. Similarly, for each arrow added to the quiver, counterweight 88 must be rotated in a counter-clockwise direction a single revolution. The apparatus shown in FIG. 9 gives an audible indication of a single revolution of weight 104.

Figure 9:
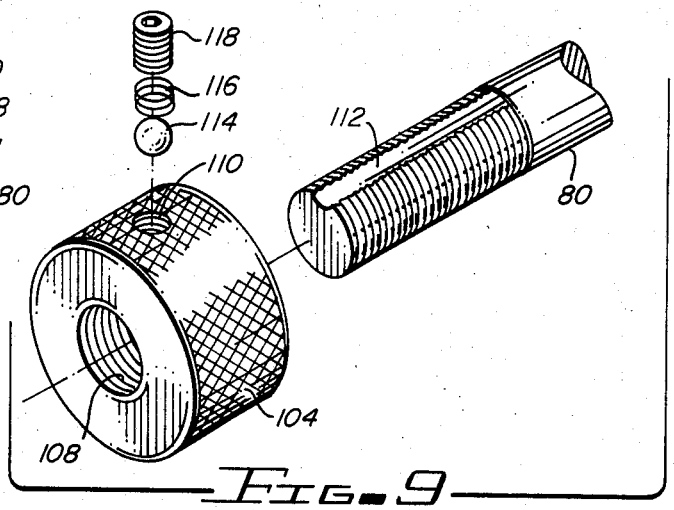
FIG. 9 is an exploded view of the adjustable counterweight apparatus used in the embodiments of FIGS. 6 and 8.
Figure 11:
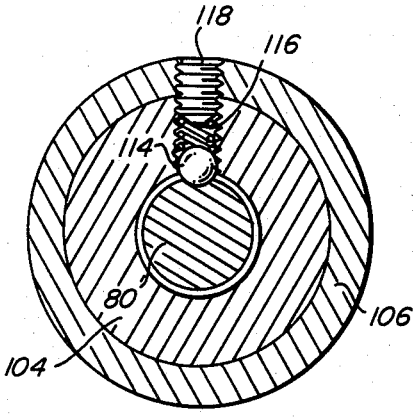
FIGS. 10 and 11 are cross-sectional views illustrating the operation of the adjustable counterweight shown in FIGS. 6, 8 and 9.
Figure 10:
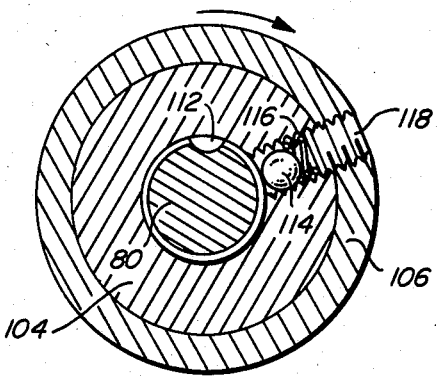

Referring to FIG. 9, weight 104 having internally threaded bore 108 therethrough has an additional bore 110 therethrough which leads to bore 108. Also, the threaded portion of cap screw 80 has a longitudinal groove 112 along an outer surface thereof. First, weight 104 is screwed onto screw 80. Next, a ball 114 is dropped into bore 110 followed by spring 116. Bore 110 is internally threaded so as to be capped by an externally threaded plug 118. Thus, ball 114 is urged against the outer surface of screw 80 by spring 116. As counterweight 88 is rotated on screw 80, ball 114 will slide along the outer surface of the threaded portion of screw 80. This is shown in FIG. 10. When the weight is rotated sufficiently to bring ball 114 into alignment with groove 112, the ball will snap into groove 112 due to the force being exerted on it by spring 116. Each time this happens, an audible click will be generated indicating to the user that counterweight 88 has been rotated a full revolution. Thus, as each arrow is either removed from or added to the quiver, it is only necessary to rotate counterweight 88 one full revolution in either a clockwise or counter-clockwise direction respectively one full revolution. This can be easily determined by the clicking sound eminating each time ball 114 falls into groove 112.

The above description is given by way of example only. Changes in form and details may be made by one skilled in the art without departing from the scope of the invention as defined by the appended claims.

I claim:

1. A quiver mountable on a bow, comprising:

storage means capable of releasably housing at least one arrow;

coupling means adopted to attach for attaching said storage means to a first side of said bow; and counterweight means mounted on said coupling means and adapted to extend extending from a second side of said bow to produce a compensating torque which substantially offsets the torque produced by the weight of said storage means and said at least one arrow.

2. A quiver according to claim 1 wherein the torque produced by said counterweight means is adjustable so as to compensate for arrows added to or removed from said storage means.

3. A quiver according to claim 2 wherein said storage means comprises:

an upper portion for receiving the point of said at least one arrow; and an arrow shaft holder for releasably securing the shaft of said at least one arrow.

4. A quiver according to claim 3 wherein said upper portion is coupled to said bow by a first threaded shaft member passing through and extending beyond said second side of said bow, and wherein said arrow shaft holder is secured to said bow by a second threaded shaft member passing through and extending beyond said second side of said bow.

5. A quiver mountable on a bow having first and second sides, comprising:

storage means capable of releasably housing at least one arrow, said storage means including (a) an upper portion capable of receiving the point of said at least one arrow, and (b) an arrow shaft holder capable of releasably securing the shaft of said at least one arrow; coupling means for attaching said storage means to said first side, said upper portion adapted to be coupled to said bow by a first threaded shaft member passing through and extending beyond said second side, and said arrow shaft holder adapted to be secured to said bow by a second threaded shaft member passing through and extending beyond said second side; and counterweight means mounted on said coupling means and extending from said second side of said bow to produce a compensating torque which substantially offsets the torque produced by the weight of said storage means and said at least one arrow, the torque produced by said counterweight means being adjustable so as to compensate for arrows added to or removed from said storage means, said counterweight means including first and second counterweights coupled to the ends of said first and second threaded shaft members, respectively, which extends beyond said second side.

6. A quiver according to claim 5 wherein said upper portion includes a filler material.

7. A quiver according to claim 6 wherein said filler material is expanded polystyrene.

8. A quiver according to claim 5 wherein said arrow shaft holder comprises:

a body secured to said bow by said coupling means; and a plurality of arrow shaft clips fixedly coupled on said body.

9. A quiver according to claim 8 wherein said body has a channel formed in an external surface thereof having a width slightly greater than the width of said arrow shaft clips, said arrow shaft clips being secured to said body within said channel to prevent twisting of said arrow shaft clips.

10. A quiver according to claim 5 wherein said arrow shaft holder comprises a body of flexible material having a plurality of apertures therein, a slot being provided from an edge of said body to each of said plurality of apertures.

11. A quiver according to claim 10 wherein said flexible material is rubber.

12. A quiver according to claim 5 further comprising locking means mounted on said first threaded shaft member to secure said upper portion to said bow, said first counterweight being longitudinally movable on said first shaft member so as to vary the twisting torque caused thereby on said bow.

13. A quiver according to claim 12 wherein said first counterweight has a first internally threaded bore therethrough which threadably engages said first shaft member and is rotatable thereon.

14. A quiver according to claim 13 wherein said locking means is a lock nut.

15. A quiver according to claim 13 wherein threads on said first threaded shaft member are spaced such that the change in twisting torque on said bow produced by rotating said first counterweight a single revolution in a clockwise or counter-clockwise direction substantially offsets twisting torque produced by removing or adding respectively a single arrow from said storage means.

16. A quiver according to claim 15 further comprising detector means for indicating when said first counterweight has been rotated a full revolution.

17. A quiver according to claim 16 wherein said detector means emits an audible sound for each revolution of said first counterweight.

18. A quiver according to claim 17 wherein said first counterweight has provided therethrough a second bore extending to said first bore and having an axis perpendicular to the axis of said first bore, said second bore for housing a spring loaded ball, and wherein said first shaft member has a longitudinal groove in the surface thereof into which said spring loaded ball falls each time said first counterweight is rotated a full revolution.

* * * * *

UNITED STATES PATENT AND TRADEMARK OFFICE

CERTIFICATE OF CORRECTION

PATENT NO. : 4,607,606

DATED : August 26, 1986

INVENTOR(S) : John Schaar

It is certified that error appears in the above-identified patent and that said Letters Patent is hereby corrected as shown below:

Column 4, Claim 1, line 4, after "means" delete "adopted" and substitute therefore -- adapted --.

Column 4, Claim 1, line 7, after "extend" delete -- extending --.

Signed and Sealed this

Twentieth Day of January, 1987

*Attest:*

DONALD J. QUIGG

*Attesting Officer*

*Commissioner of Patents and Trademarks*